United States Patent [19]

Campisano

[11] 4,133,143

[45] Jan. 9, 1979

[54] HINGE ARRANGEMENT

[76] Inventor: Fred M. Campisano, Yorktown Heights, New York, N.Y. 10598

[21] Appl. No.: 546,896

[22] Filed: Feb. 4, 1975

[51] Int. Cl.[2] ..... E05D 7/08

[52] U.S. Cl. ..... 49/388; 49/162; 16/135

[58] Field of Search ..... 49/398, 388; 16/135

[56] References Cited

U.S. PATENT DOCUMENTS

| | | | |
|---|---|---|---|
| 1,385,800 | 7/1921 | Sogg | 49/398 X |
| 2,209,659 | 7/1940 | Mercer | 49/398 X |
| 2,619,204 | 11/1952 | Troche et al. | 49/398 |
| 2,808,610 | 10/1957 | Minor | 49/398 X |
| 2,923,036 | 2/1960 | Beyrle | 49/388 |
| 3,099,866 | 8/1963 | Matranga | 49/388 X |
| 3,299,573 | 1/1967 | Gustafson | 49/388 |
| 3,320,699 | 5/1967 | Carson et al. | 49/399 |
| 3,395,423 | 8/1968 | Bus | 49/388 X |

*Primary Examiner*—Kenneth Downey
*Attorney, Agent, or Firm*—Stephen B. Judlowe

[57] ABSTRACT

A hidden hinge construction for use in hingedly fastening one member to another member includes first and second parts which are adapted to be countersunk into the members. Each of the parts has appended thereto a plate which is respectively adapted to be fastened to the member. One of the hinge parts includes a projecting pin, and to the other hinge part includes an axial opening for rotatively receiving the pin.

1 Claim, 10 Drawing Figures

HINGE ARRANGEMENT

This invention relates to an improved closure apparatus and, more specifically, to an improved hinge structure. This application is related to my earlier filed application which issued on Feb. 5, 1974, as U.S. Pat. No. 3,789,548.

Prior art residential and industrial window arrangements are typically of two basic forms. In a sash window, often of the double hung variety, two (or more) glass-containing window sashes slide vertically within associated, dedicated tracks. Because the outer side of such sash windows is not readily accessible from within the enclosed room containing the window, window cleaning and repair become difficult, tedious and, moreover, dangerous as individuals must lean outside buildings or across outside ladders to perform these maintenance functions.

The second, or casement basic window form comprises a glass member hinged for rotation in a fixed arc. When the glass is adapted to rotate outward, casement windows suffer the same infirmities as sash windows relating to the inaccessibility of the outer glass side. Moreover, for either direction or rotation, casement type windows typically do not provide free access to the entire window width as desirable, for example, for mounting air conditioners. Further, casement windows produce significant unesthetic projections from the window plane when opened.

It is therefore the object of the present invention to provide an improved window arrangement.

More specifically, an object of the present invention is the provision of an improved window organization which slides within a frame thus not providing unsightly projections when opened, and which is selectively rotatable into a room to afford ready access for cleaning, repair, or the like.

Another object of the present invention is the provision of an improved window arrangement which is selectively rotatable, and which returns to a quiescently closed position when released.

The above and other objects are realized in a specific, illustrative window arrangement formed by one or more window sashes each adapted to vertically slide in an associated, dedicated track in a mounting frame. A glass pane is secured to the sash. The window sash may vertically translate within its associated track in a conventional manner.

To clean or repair the window, the glass and its supporting assembly is rotated about the axis of the mounting rod into the room enclosure for ready access. A torsion spring and/or an offset center of gravity for the window pane is provided to automatically return the glass to a closed position when released, and rotatable keys are employed to secure the glass to a closed state.

The above and other objects, features and advantages of the present invention are realized in an illustrative embodiment of the present invention, discussed hereinbelow in conjunction with the accompanying drawing, in which.

Figure 3:
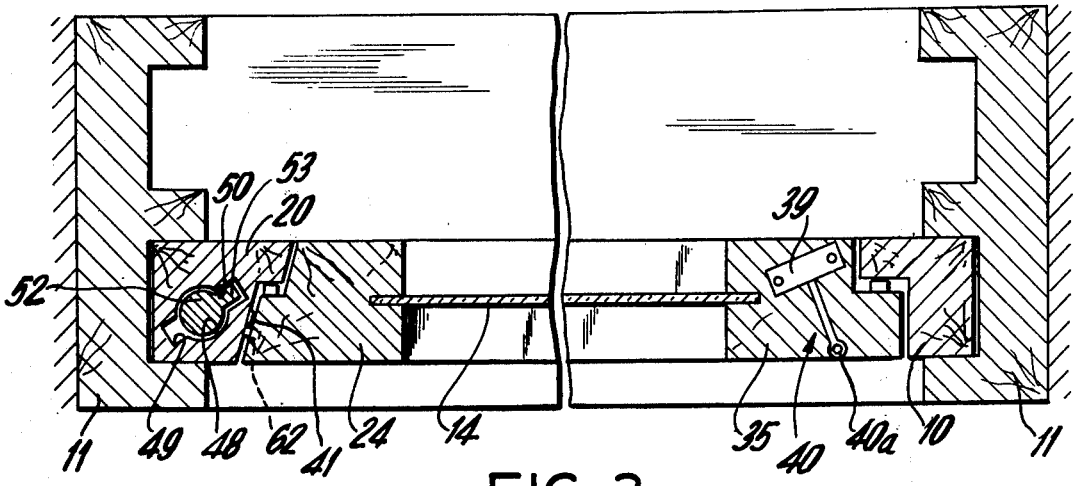
Figure 4:
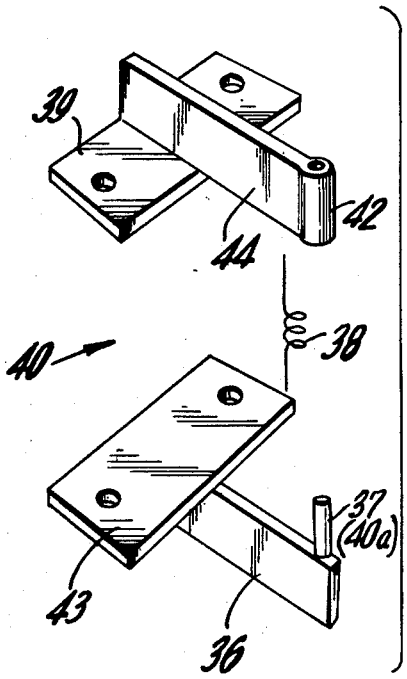
Figure 5:
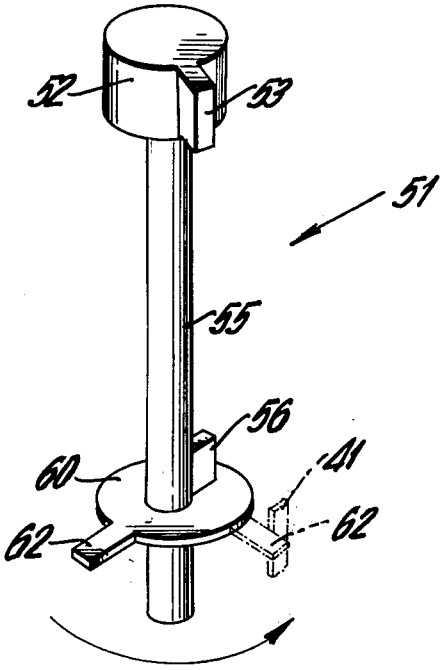
Figure 6:
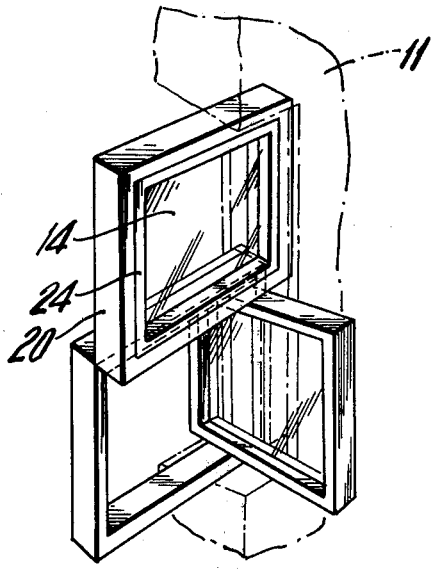
Figure 7:
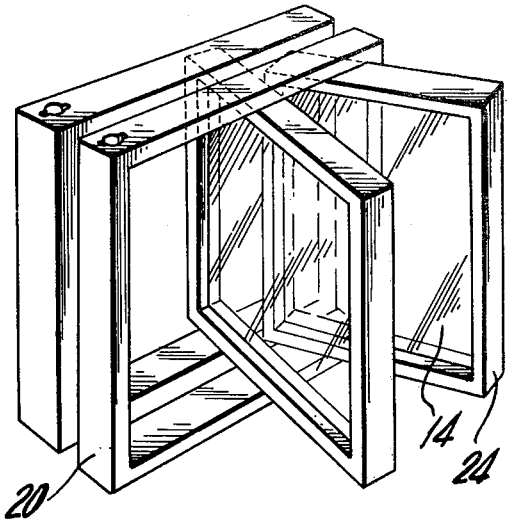
Figure 8:
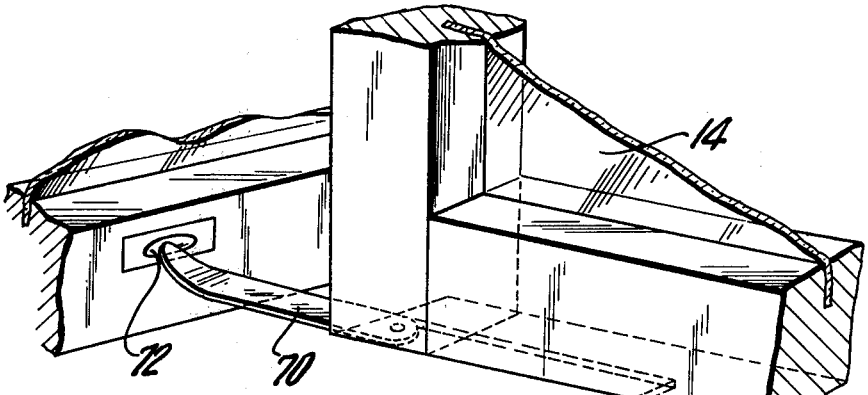
Figure 9:
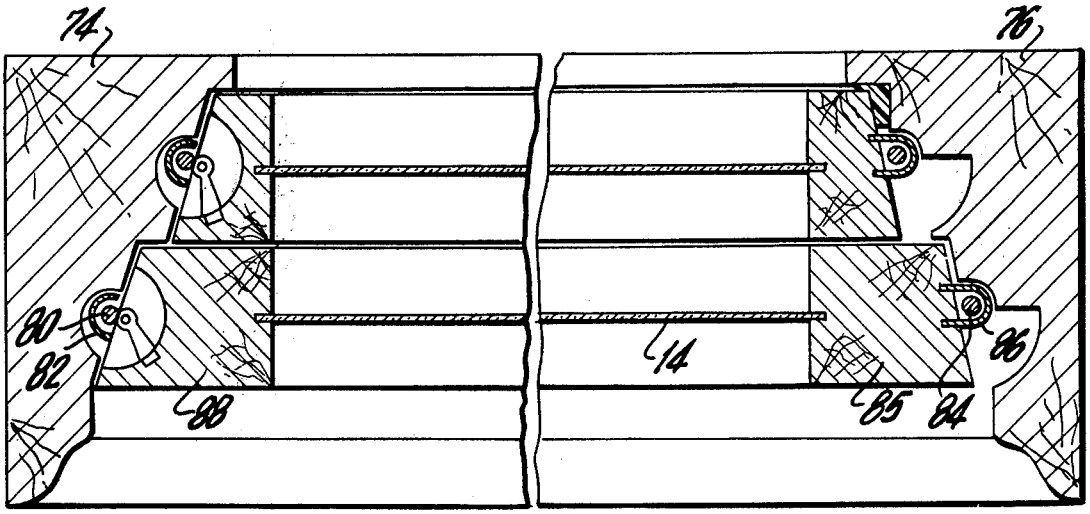
Figure 10:
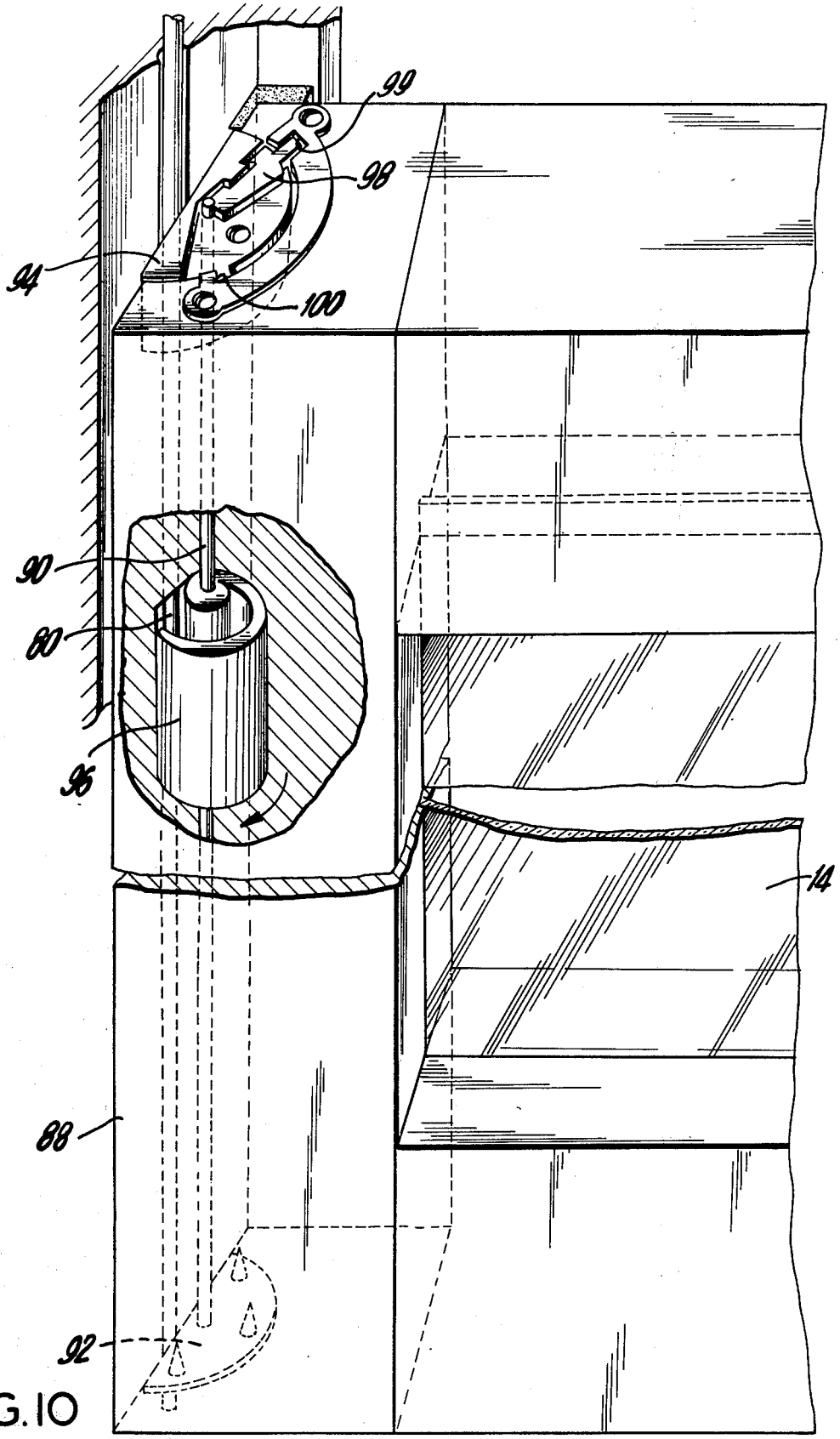

FIG. 3 comprises a cross-sectional view of a second window embodiment in accordance with the principles of the present invention;

FIG. 4 is an exploded view depicting hinge apparatus used for the window of FIG. 3;

FIG. 5 illustrates latch apparatus employed in the window arrangement of FIG. 3;

FIG. 6 illustrates an attitude for the FIG. 3 window, wherein the window pane for the upper sash is opened;

FIG. 7 depicts an attitude for the FIG. 3 window wherein both the upper and lower panes are coincidentally opened;

FIG. 8 illustrates safety holder apparatus for maintaining the FIG. 3 window in an open orientation;

FIG. 9 is a cross-sectional view of a third illustrative window embodiment incorporating the principles of the present invention; and FIG. 10 illustrates lock apparatus for the FIG. 9 window.

Figure 1:
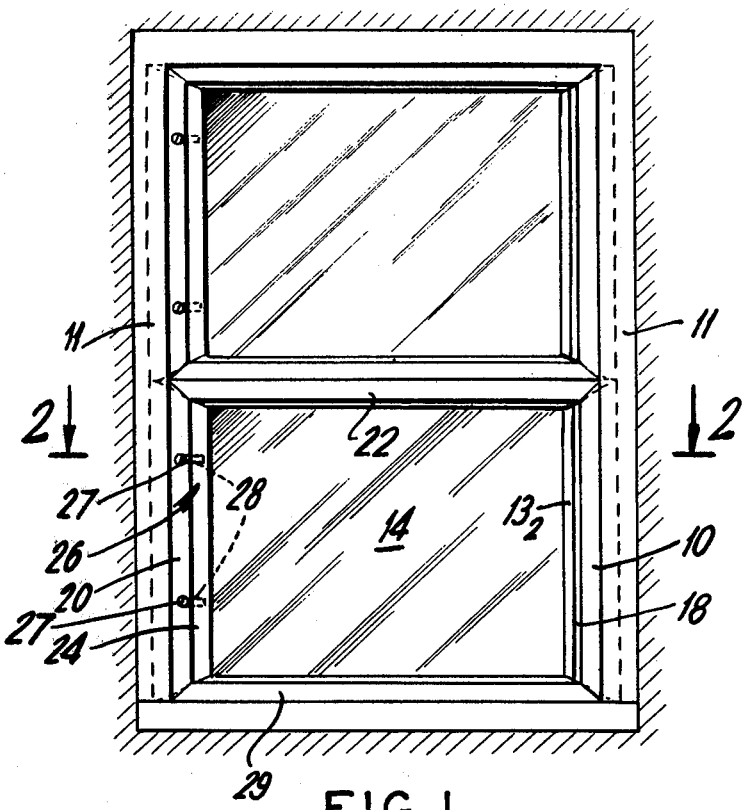
FIG. 1 is a front view of a first window arrangement embodying the principles of the present invention.
Figure 2:
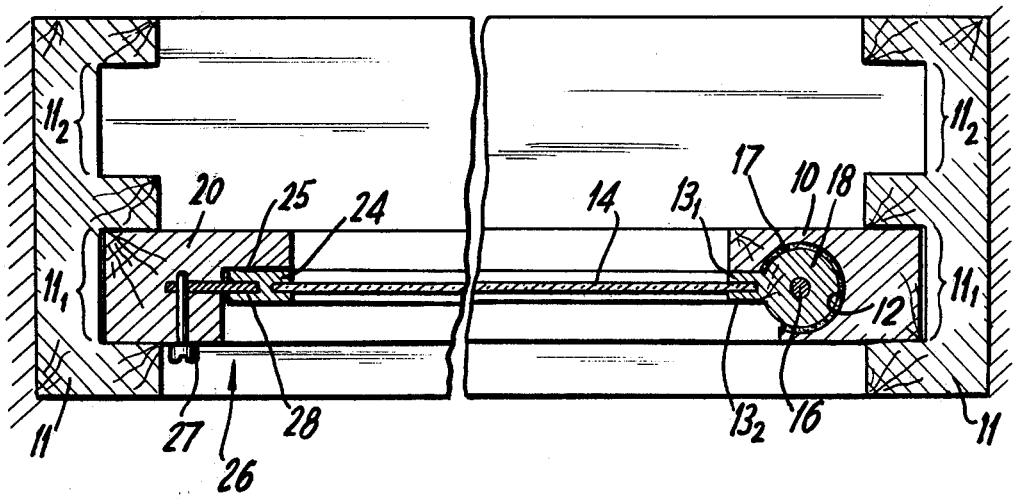
FIG. 2 is a cross-sectional view of the window track and glass mounting apparatus taken along the axis 2-2' in FIG. 1.

Referring now to FIGS. 1 and 2, there is shown a first window arrangement having two glass containing window sashes respectively adapted to slide within tracks $11_1$ and $11_2$ of a frame 11. The two sashes being substantially identical, only the lower sash, sliding within the track $11_1$, is shown in detail in the drawing. The lower window sash includes top and bottom transverse members 22 and 29, and right and left lateral side members 10 and 20, respectively. The members 10, 20, 22 and 29 may be fabricated of any desired construction material, e.g., wood, metal, plastic or the like.

The right sash member 10 includes a truncated cylindrical aperture 12, and a rod-like cylindrical element 18 is disposed within the aperture 12. The diameter of the rod 18 is made larger than the removed, truncated portion of the opening 12 such that the rod 18 cannot be laterally removed from the sash member 10.

Two projections $13_1$ and $13_2$ are included on the rod 18 (or, alternatively, a slot is included within the rod 18) and a glass window pane 14 is secured between the projections 13 (or within the slot within the rod 18) which may also include a bottom glass support member affixed thereto.

A rod 16 (or simply top and bottom pins) is disposed at the center of the rod 18, and projects into holes (or a lined sleeve bushing or bearing construction) in the top and bottom sash members 22 and 29. Also, a glass termination strip 24 may be employed at the "free", or left side of the glass pane 14.

The assembled and integral rods 16 and 18, the glass 14 and the left termination 24 may selectively rotate about the axis of the journal mounted rod 16, with packing 17 being disposed between the outer periphery of rod 18 and the inside of aperture 12 for insulation purposes, and also to provide viscous damping to obviate unduly rapid rotation (with the concomitant even more rapid deceleration) of the glass 14. Similarly, insulating (and impact absorbing) packing 25 is employed between the members 20 and 24.

Locking elements 26, including a head portion 27 and an integral extended key portion 28, are included on the left frame member 20. When the locking elements 26 reside in the orientation shown in FIGS. 1 and 2, the key projections 28 thereof inhibit rotation of the window glass 14. By rotating the key portion 28 ninety degrees upward (as with torque applied by a screw driver or coin inserted in a slot in the head portion 27), the glass 14 becomes free to rotate by simply grasping the element 24 and applying an inward torque.

In accordance with one aspect of the present invention, the glass 14 may be made self-returning, i.e., adapted to return to the closed position shown in the drawing when released. To this end, one or more torsion springs can be disposed about the axis of the pins 16 and/or 18. The torsion spring, of any well known construction, is compressed when the glass is rotated, and expands to reset the glass when the glass assembly is released. Further, in addition to, or in place of the torsion spring, the window sash and the associated track 11 may be canted (upper edge into the plane of FIG. 1) such that the center of gravity of the glass assembly lies behind the lower glass edge. The weight moment of the glass will then serve to return the pane 14 to a closed position when a rotated glass assembly is released.

By way of functional operation of the window organization of FIGS. 1 and 2, the glass panes 14 normally reside in the closed position shown in the drawing, and are locked in this position by the extended key portions 28. The two sashes may slide through their respective tracks $11_1$ and $11_2$ to a maximum open position (the two sashes aligned) or to a closed state (completely offset sashes) as is conventional for sash windows.

Where a window is to be repaired, cleaned or the like, it is brought to a convenient, unobstructed height. The head portions 27 of lock elements 26 are then rotated to rotate the key portions 28 thereof at least ninety degrees such that the glass termination 24 is freed. The free (left) side of the glass 14 (e.g., the member 24) is pulled to rotate the integral glass assembly into the room or building enclosure, the rod 16 serves as an axis.

After the desired work has been performed, the pane 14 may simply be released, and the torsion spring, weight offset, or the like automatically returns the glass 14 to its quiescently closed position. The locking element 26 is then rotated to resecure the glass, and the composite sash may again vertically translate to any desired position.

The window of FIGS. 1 and 2 has thus been shown by the above to possess all attributes of sash window configurations and, moreover, to be selectively rotatable to provide ready access for safe maintenance purposes.

Referring now to FIGS. 3–8, there is shown a second illustrative embodiment of the present invention, like reference numerals being used to identify corresponding structural elements for the several window embodiments. In FIG. 3 the glass window pane 14 in one of the sashes, e.g., the lower sash, terminates at inner frame members 24 and 35 (horizontally disposed subframe members advantageously being employed as well). The composite pane 24-14-35 is secured by hinge apparatus 40 to the outside frame of the sash. The inner frame-pane structure therefore effectively pivots about a point **40*a* at or near the front right corner of the pivoting pane assembly. A corresponding hinge 40** is included at the bottom of the pane assembly.

The hinge structure 40 is shown in particular detail in FIG. 4, and includes lower and upper members 36 and 44 having body portions which are countersunk in corresponding main-inner frame sash members. The hinge body portions 44 and 36 have appended plate portions 39 and 43 which are connected by fasteners to the appropriate sash members. A hollow tubular collar 42 in the member 44 is rotationally disposed about a pin 37 in the mating hinge member 36, and a torsion spring 38 mounted about the collar 42 to bias the pane in a closed position.

Window locking structure is included in the left sash member and includes a vertical hollow aperture 48 having slot keyways 49 and 50 at its top. Lock mechanism 51 located in the aperture 48 is shown in FIG. 5 and includes a trunk portion 55, an expanded head portion 52 with a projecting key 53, a further key 56, and a locking member 60 having a projecting part 62.

With the locking structure 51 in place with the key 53 in the slot 49, the locking projection 62 is disposed remote from the pane, terminating side member 24 such that the pane may be opened by an inward torque against the retarding action of the spring 38. Conversely with the key 53 in the slot 50 as shown in the drawing, the projecting portion 62 projects into a recess in the inner frame member 24 and abuts a stroke plate 41 on the surface of the pane member 24. When so positioned, the arm 62 prevents the window from being opened.

Like structure may be employed for the upper sash. Thus, FIG. 6 depicts a window arrangement with the upper and lower sashes reversed within the separate dedicated tracks of an outer window frame 11 (FIG. 3), the figure also schematically depicting the normally upper window pane-inner frame rotated to an open position.

Correspondingly, FIG. 7 depicts an arrangement with both upper and lower sashes aligned, wherein both the upper and lower window panes are in an open position, as for cleaning. It is one of the important features of the present invention that the upper pane may be opened through the lower pane for servicing and is thus made sufficiently small so that this may be effected. Further, with respect to FIG. 7, it will be appreciated that the lower sash must be held open against the torque of the spring 38 to prevent the lower pane from striking the upper pane. To this end, and with respect to FIG. 8, the bottom of the lower sash includes a pivoting arm 70 which fits within, and is retained by a slot 72 in the bottom of the upper sash. The safety mechanism 70-72 is thus operative only when the upper sash is completely behind the lower sash eliminating a potentially dangerous condition.

Referring now to FIG. 9, there is shown a third window embodiment depicting the principles of the present invention. The window of FIG. 9 comprises two vertically oriented rods for each of the upper and lower sashes, e.g., rods 80 and 84 for the lower sash. Each sash comprises a peripheral pane frame (only a single frame, vis-a-vis the double frames for the embodiments of FIGS. 1 and 3). The rods associated with the upper and lower sashes are directly secured within a housing, housing side wall members 74 and 76 being shown in the cross-sectional view of FIG. 9. Each sash is mounted for selective vertical sliding translation along the rods associated therewith, as by circular collars disposed around a rod and secured to the sash side wall members. Thus, see the retaining members 80 and 86 for the lower sash, it being understood that these members 80 and 86 are either continuous elongated elements, or plural spaced collar elements. Assuming opening about a pivot point to the right in FIG. 9, each sash simply pivots about the right rod, e.g., the rod 84 for the lower sash, the right frame including suitably shaped recesses — see the recess 87, to permit rotation of the right side wall member 85.

To lock either of the sashes of the FIG. 9 (FIG. 10) window construction to a closed state, a further rod 90 is disposed within the left sash frame 88 to provide a lock mechanism for the lower sash, comparable apparatus being employed for the upper sash. The rod 90 is secured to the frame as by a bottom plate 92 and a top mechanism 94. Fixedly secured to the rod 90 are one or more helical members 96, the rod 90 being selectively rotated by an actuator member 98 at its upper end which is adapted to reside in one of two slots 99 or 100. With the member 98 in the slot 99, the helical members 96 do not engage the tubular track-rod 80 and the lower sash may simply be rotated inwardly into the room. Correspondingly when the rod 90 is rotated clockwise about its axis by positioning the element 98 in the slot 100, the helical members 96 engage and surround the rod 80 such that the window may not be rotated open.

Thus, each of the above arrangements has been shown by the above to provide an improved window structure.

It is to be understood that the above-described window arrangement is merely illustrative of the principles of the present invention. Numerous modifications and adaptations thereof will be readily apparent to those skilled in the art without departing from the spirit and scope of the present invention. For example various further appurtenances may be employed for the window structures set forth above. Thus, a safety bar may be employed in the FIG. 9 window assembly to prevent undue translation of the various window sashes. Then, also, the window embodiments herein may employ latch structure — as between the top of the lower sash and the bottom of the upper sash — to secure the two window sashes together obviating relative vertical movement therebetween.

What is claimed is:

1. A hinge for hingedly fastening a first member to a second member permitting relative rotation therebetween about an axis of rotation, said first and second member respectively including first and second contiguous, overlapping parallel planar surfaces orthogonal to said axis of rotation, each of said surfaces having an edge orthogonal to said axis of rotation, said hinge comprising a first part including a first plate member adapted to be fastened to said first planar surface of said first member, and a first arm member attached to said first plate member and extending substantially normally thereto and outwardly therefrom, an opening being formed near the outwardly extending end of said arm member; said opening being aligned with said axis of rotation; and a second part including a second plate adapted to be fastened to said second planar surface of said second member, a second arm member attached to said second plate and extending substantially perpendicularly thereto and outwardly therefrom and a pin extending upwardly from the outwardly extending end of said arm member and adapted to be rotatively received in said opening, said opening in said first part, said pin of said second part and said axis of rotation being disposed within the area of said overlap and substantially at said edges.

* * * * *